US009307327B2

(12) United States Patent
Tang et al.

(10) Patent No.: US 9,307,327 B2
(45) Date of Patent: Apr. 5, 2016

(54) PORTABLE ELECTROACOUSTIC DEVICE

(71) Applicants: Yun Tang, Shenzhen (CN); Rongguan Zhou, Shenzhen (CN)

(72) Inventors: Yun Tang, Shenzhen (CN); Rongguan Zhou, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 72 days.

(21) Appl. No.: 14/252,891

(22) Filed: Apr. 15, 2014

(65) Prior Publication Data

US 2015/0296304 A1 Oct. 15, 2015

(30) Foreign Application Priority Data

Apr. 15, 2013 (CN) ..... 2013 2 0186703 U

(51) Int. Cl.

| | |
|---|---|
| ***H04R 1/02*** | (2006.01) |
| ***H04R 9/06*** | (2006.01) |
| ***H04R 19/02*** | (2006.01) |
| ***H04R 3/00*** | (2006.01) |

(52) U.S. Cl.
CPC ..... *H04R 19/02* (2013.01); *H04R 1/02* (2013.01); *H04R 3/00* (2013.01)

(58) Field of Classification Search
CPC ..... H04R 2499/11; H04R 5/02
USPC ..... 381/334
See application file for complete search history.

(56) References Cited

U.S. PATENT DOCUMENTS

| | | | | |
|---|---|---|---|---|
| 2010/0296690 | A1* | 11/2010 | Shao | H04R 9/06 381/400 |
| 2010/0329503 | A1* | 12/2010 | Shao | H04R 9/046 381/409 |
| 2012/0170783 | A1* | 7/2012 | Zha | H04R 9/025 381/332 |
| 2012/0269377 | A1* | 10/2012 | Yuan | H04R 9/025 381/386 |
| 2014/0056465 | A1* | 2/2014 | Li | H04R 9/025 381/400 |

* cited by examiner

*Primary Examiner* — Simon King
(74) *Attorney, Agent, or Firm* — IPro, PLLC; Na Xu

(57) ABSTRACT

Disclosed is a portable electroacoustic device. The device includes a shell having a receiving space; a fixing part received in the receiving part and connected with the shell, and a vibrating unit positioned in the receiving space. The vibrating unit includes a vibrating system and a magnetic circuit system fixed with the fixing part for driving the vibrating system. The magnetic circuit system has a magnetic gap. The vibrating system includes a vibrating plate for driving an external medium to generate resonate, and a voice coil inserted in the magnetic gap for driving the vibrating plate. The shell includes a lower plate having a through hole, the vibrating plate connects with the lower plate and is accommodated in the through hole.

6 Claims, 1 Drawing Sheet

PORTABLE ELECTROACOUSTIC DEVICE

FIELD OF THE INVENTION

The disclosure described herein relates generally to electronic devices, and more particularly, to a portable electroacoustic device.

DESCRIPTION OF RELATED ART

With the development of technologies, the portable electronic devices, like laptop, cellphone and tablet, become a necessity of people's everyday life. People are not only content with the communication function of these electronic devices, but also request the electronic devices are more entertaining and the appearances thereof are more fashionable.

The sound effect is an important criteria of the entertainment function of the electronic devices. Consequently, people have been always involved in improving the performance of the electroacoustic devices in those portable electronic devices. A related electroacoustic device typically includes a frame, a magnetic unit in the frame, and a vibrating unit positioned on the frame. The electroacoustic device usually cannot be made into a small size because of the frame, which becomes a barrier to the development of small form portable electronic devices.

Therefore, an improved portable electroacoustic device is provided in the present disclosure to solve the problem mentioned above.

Figure 1:
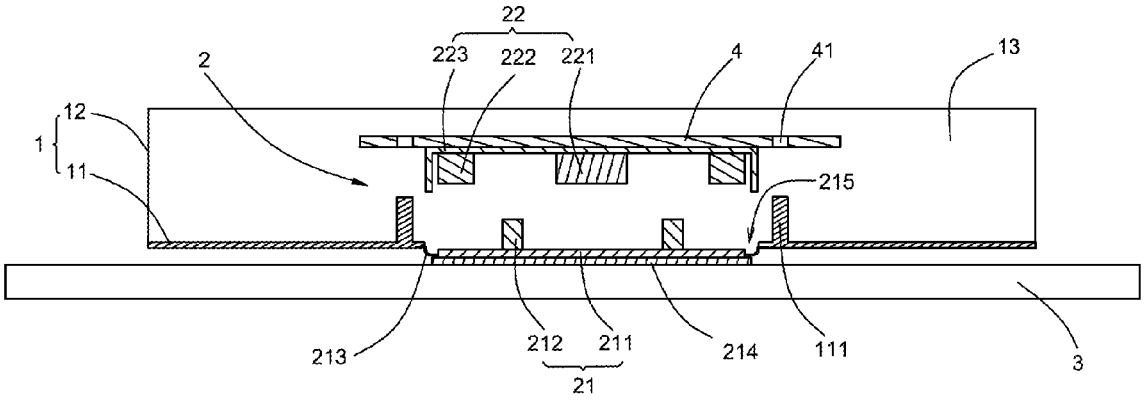
FIG. 1 illustrates a partial exploded view of a portable electroacoustic device in accordance with an exemplary embodiment of the present disclosure.
Figure 2:
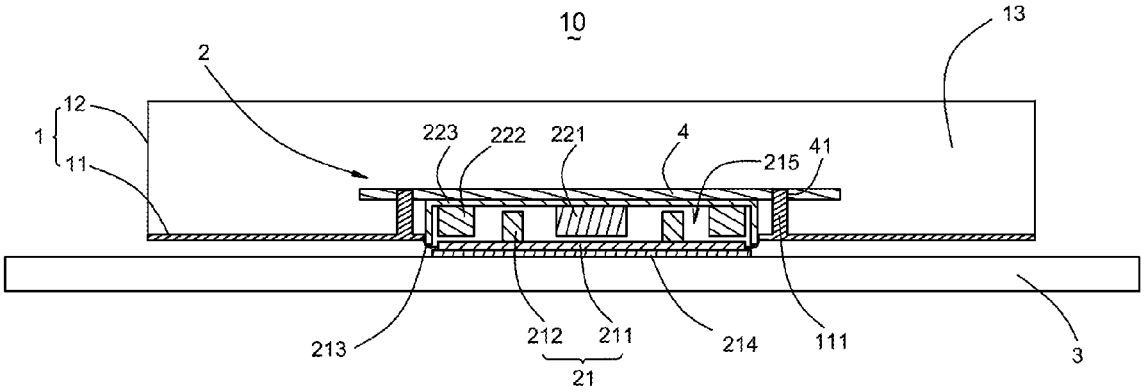
FIG. 2 illustrates an assembled view of the portable electroacoustic device.

Many aspects of the embodiment can be better understood with reference to the drawing mentioned above. The components in the drawing are not necessarily drawn to scale, the emphasis instead being placed upon clearly illustrating the principles of the present disclosure. Moreover, in the drawing, like reference numerals designate corresponding parts throughout the several views.

DETAILED DESCRIPTION OF THE EXEMPLARY EMBODIMENT

Reference will now be made to describe the exemplary embodiment of the present invention in detail.

Referring to FIG. 1, the present disclosure provides a portable electroacoustic device 10 positioned on an external medium 3 to produce resonance thereby generating a low frequency sound. The device 10 comprises a shell 1 having a receiving space 13, a vibrating unit 2 positioned in the shell 1, a coupling part 214 sandwiched between the vibrating unit 2 and the external medium 3, and a fixing part 4 received in the receiving space 13 and connected with the shell 1. The fixing part 4 has a positioning hole 41. The vibrating unit 2 comprises a vibrating system 21 and a magnetic circuit system 22 for driving the vibrating system 21. The vibrating system 21 comprises a vibrating plate 211 attached on the coupling part 214 and cooperating with the coupling part 214 for driving the external medium 3 to produce resonance thereby generating a low frequency sound, and a voice coil 212 for driving the vibrating plate 211 to vibrate. The shell 1 has a lower plate 11 and an upper cover 12 coupled with the lower plate 11. The lower plate 11 has a through hole 215 and a positioning column 111 surrounding the through hole 215. The vibrating plate 211 is accommodated in the through hole 215. In this exemplary embodiment, the vibrating system 21 further comprises a spring 213. One end of the spring 213 connects with the lower plate 11 and the other connects with the vibrating plate 213. The magnetic circuit system 22 comprises a yoke 223, a main magnet 221 accommodated in the yoke 223, and an auxiliary magnet 222 surrounding the main magnet 221. The main magnet 221 forms a magnetic gap together with the auxiliary magnet 222. The whole magnetic circuit system 22 is opposite to the vibrating system 21, so that one end of the voice coil 212 is positioned in the magnetic gap and driven by the magnetic circuit system 22. For example, when the portable electroacoustic device is working on the desk, the vibrating plate 211 engages with the desk to form a coupling and the voice coil 212 is electrified and drives the vibrating plate 211 to vibrate which produces resonance with the desk and then generates low frequency sound. Under this situation, the desk is the external medium 3. The vibrating plate 211 integrated with the lower plate 11 reduces the thickness of the portable electroacoustic device. It should be noted that the external medium 3 is not limited to the desk, and it can be other mediums, such as box, wall, platform, etc.

The surface of the vibrating plate 211 far away from the magnetic circuit system 22 engages with the coupling part 214. The coupling part 214 is elastic, which can reduce the resonance frequency and improve the low frequency sound performance of the portable electroacoustic device. The coupling part 214 can be made from soft silica gel or foam. Furthermore, compared with the vibrating plate 211 directly engaged with the desk, the vibrating plate 211 engaged with the desk via the coupling part 214 makes the transmission of the vibration of the vibrating plate 211 more effective, reduces the energy losses during the transmission, and improves the low frequency acoustic performance of the portable electroacoustic device.

In this embodiment, the fixing part 4 is a printed circuit board (PCB), and the magnetic circuit system 22 is fixed on the PCB board. Compared with the related electroacoustic device, the frame can be omitted. The vibrating system 21 and the magnetic circuit system 22 respectively integrated with the shell 1 and the PCB board reduces the thickness of the portable electroacoustic device. The portable electroacoustic device of the present invention reduces the cost and installation space, and the structure of the portable electronic device is simplified.

In this embodiment, the lower plate 11 has several positioning columns 111 extending from the lower plate 11 towards the PCB board, the positioning columns 111 are respectively received in the positioning holes 41 in the PCB board for integrating the magnetic circuit system 22 with the vibrating system 21 firmly. As an alternative embodiment, the lower plate can also be engaged with the fixing part by screws. The portable electroacoustic device may be a cell phone, a laptop computer and so on.

While the present disclosure has been described with reference to the specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. A portable electroacoustic device, comprising:

a shell having a receiving space;

a fixing part received in the receiving space and connected with the shell; and a vibrating unit positioned in the receiving space, comprising a vibrating system and a magnetic circuit system fixed with the fixing part for driving the vibrating system; the magnetic circuit system having a magnetic gap, the vibrating system comprising a vibrating plate for driving an external medium for generating resonate, and a voice coil inserted in the magnetic gap for driving the vibrating plate;

wherein the shell comprises a lower plate having a through hole, the vibrating plate connects with the lower plate and is accommodated in the through hole.

2. The portable electroacoustic device as described in claim 1, wherein the fixing part is a printed circuit board.

3. The portable electroacoustic device as described in claim 1 further comprising a spring, wherein the vibrating plate is connected with the lower plate by the spring.

4. The portable electroacoustic device as described in claim 1, wherein the lower plate has a positioning column extending from the lower plate towards the fixing part, and the fixing part has a positioning hole for receiving the positioning column.

5. The portable electroacoustic device as described in claim 4 further comprising a coupling part attached on the vibrating plate away from the magnetic circuit system.

6. The portable electroacoustic device as described in claim 5, wherein the material of the coupling part is selected from soft silica gel or foam.

* * * * *